US005131874A

United States Patent [19]

Seido

[11] Patent Number: 5,131,874

[45] Date of Patent: Jul. 21, 1992

[54] FEMALE CONTACT IN A CONNECTOR

[75] Inventor: Masami Seido, Tokyo, Japan

[73] Assignee: Witco of Jupiter Dentsu Co., Ltd., Tokyo, Japan

[21] Appl. No.: 718,549

[22] Filed: Jun. 20, 1991

[30] Foreign Application Priority Data

Jun. 26, 1990 [JP] Japan ..... 2-165570

[51] Int. Cl.[5] ..... H01R 11/22

[52] U.S. Cl. ..... 439/857; 439/636; 439/842

[58] Field of Search ..... 439/842, 389, 402, 403, 439/861, 862, 849, 850, 833, 839, 856, 857, 816, 630-637

[56] References Cited

U.S. PATENT DOCUMENTS 2,289,172 7/1942 Beal ..... 439/857
2,628,292 2/1953 Mastney ..... 439/857
3,818,423 6/1974 McDonough ..... 439/857
4,408,824 10/1983 Weidler ..... 439/857
4,795,379 1/1989 Sasaki et al. ..... 439/856

FOREIGN PATENT DOCUMENTS 0062334 5/1892 Fed. Rep. of Germany ..... 439/850

*Primary Examiner*—David L. Pirlot
*Attorney, Agent, or Firm*—Poms, Smith, Lande & Rose

[57] ABSTRACT

A female contact is used in an electrical connector for a computer or electronic equipment. An elongated conductive piece of the contact is punched with a press and has narrower end portions at both ends. One narrower portion is symmetrical to the other around the center of piece. When the piece is folded on itself at the center, the overlapped narrower portions form a forked receiver suitable to receive a male contact terminal.

9 Claims, 2 Drawing Sheets a2=0.2mm
a2=0.1mm
a1=0.9mm
a3=3mm
a4=0.35mm
a5=0.2mm

FEMALE CONTACT IN A CONNECTOR

BACKGROUND OF THE INVENTION

The present invention relates to a female contact in a connector and a method of assembling the same. A high-density multicore connector is used in a computer and electronic equipment.

Male and female contacts are used in a connector. For example, a female contact 102 in a connector 101 as shown in FIG. 5 is flat and simple in structure, which is suitable to miniaturization and high density formation.

The contact 102 is punched in plate material such as copper alloy having low contact resistance and high elasticity, with a press. Two protrusions 105 and 105 are provided to form a forked contact portion 104 at the front end of a middle conductive body 103, and a slit 106 is provided between the two protrusions 105 and 105. The rear end thereof has a contact portion 107 connected to a printed circuit board or a cable core.

A connector 101 has a synthetic resin casing 108 in which there are provided conductive pieces 103 of a plurality of contacts 102 which are arranged in parallel. The front end of the casing 108 has a bore 109 which receives the contact protrusions 105, and the contact portion 107 projects rearwardly.

The numeral 110 denotes a connection which is provided on a printed circuit board, and the numeral 111 denotes a conductive contact terminal which is inserted in the slit 106.

The connection 110 engages with the bore 109 in the connector 101, thereby allowing the slit 106 to engage with the contact terminal 111. The contact terminal 111 is inserted between the protrusions 105 and 105 to spread out elastically, thereby becoming electrically conductive.

Recently, with miniaturization and high density formation of a connector, instead of standard terminal pitch of 0.1 inches (2.54 mm), the pitch of 0.05 inches (1.27 inches) as called "half-size" has been demanded; so it is necessary to decrease the contact in size to less than a half and in thickness "t".

But the elastically-bendable area of the forked contact portion 104 is small between the two protrusions 105 and 105; so it requires a large force to mount and remove the connector 101, which leads difficulty for safety mounting and removing. The adjustment in width "d" of the slit 106 or thickness of the connection 110 results in poor contact. So it is necessary to broaden elastically-bendable area by forming the length of the protrusion 105 or length "L" of the slit 106 as large as possible.

Further a plurality of parallel contacts 102 involve variation in height when the connector 101 is manufactured. To make the connection 110 bendable depending on the variation in height, it is necessary to reduce the thickness of the connection 110 of the printed circuit board as film or the width "d" of the slit 106.

However the elongated slit 106 leads difficulty in punching since narrower press is required to form the slit 106 when the contact 202 is punched with the press, thereby making miniaturization of the contact impossible.

The thickness of blade for punching the slit 106 has to be as large as the thickness "t" of processed plate material, and the width "d" of slit 106 smaller than the thickness "t" makes processing difficult.

Owing to high density formation in electronic equipement, less than hald-size terminal pitch has been required, but, to perform such high density formation, it is necessary to employ an extremely thin film substance as contact terminal having conductive foils on which circuits are printed and wired at one side. The thickness of the film substrate becomes smaller than the thickness "t" of the material for the contact 102, making it impossible to make the forked contact 102.

SUMMARY OF THE INVENTION

According to the one aspect of the present invention, there is provided a female contact for a connector, the contact comprising an elongated conductive piece, and narrower end portions at both ends of the piece, the narrower end portions being symmetrical to each other around the center of the piece, the piece being folded on itself at the center fo the piece so that the overlapped narrower end portions may form a forked receiver suitable to receive a contact terminal.

According to another aspect of the present invention, there is provided a method of assembling a female contact for a connector, the method comprising the steps of punching a conductive piece having narrower end portions at both ends with a press, the narrower end portions being symmetrical to each other around the center of the piece, and folding the piece on itself at the center so that the overlapped narrower end portions may form a forked receiver suitable to receive a contact terminal.

When the conductive piece is punched through material with a press in the contact according to the present invention, there is no need for forming a slit. Thus the contact smaller than a known contact and having a slit the width of which is selectively determined can be easily manufactured.

BRIEF DESCRIPTION OF THE DRAWINGS

The above and the other features and advantages of this invention will be described in detail according to the following emdodiments with reference to appended drawings wherein.

DESCRIPTION OF THE PREFERRED EMBODIMENT

FIGS. 1 to 4 illustrate one embodiment of the present invention.

Figures 1, 2, 3, 4:
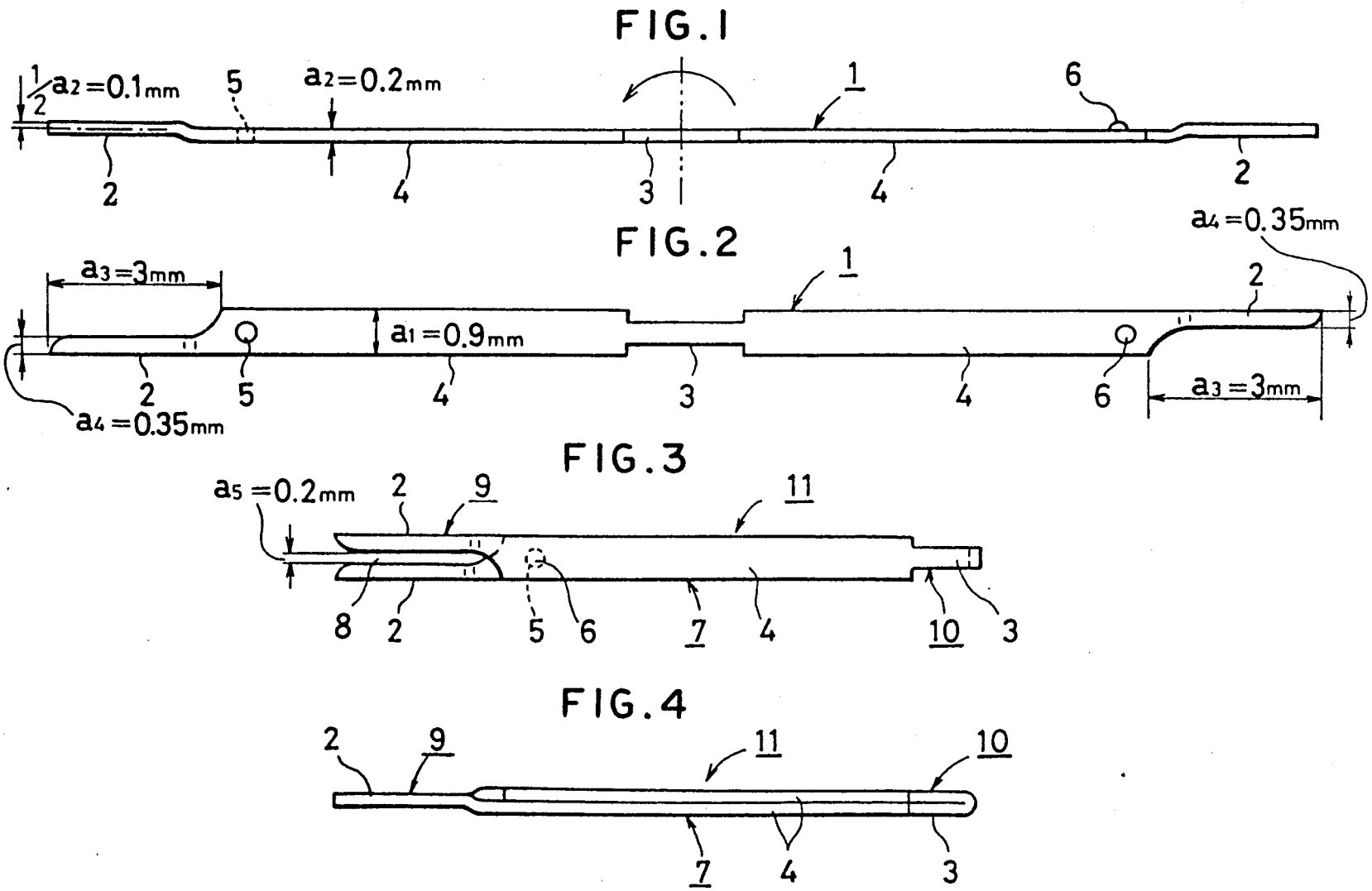
FIG. 1 is a front view of a conductive piece in a contact according to the present invention.
FIG. 2 is a plan view thereof.
FIG. 3 is a front view of a contact of the present invention.
FIG. 4 is a plan view thereof.
Figure 5:
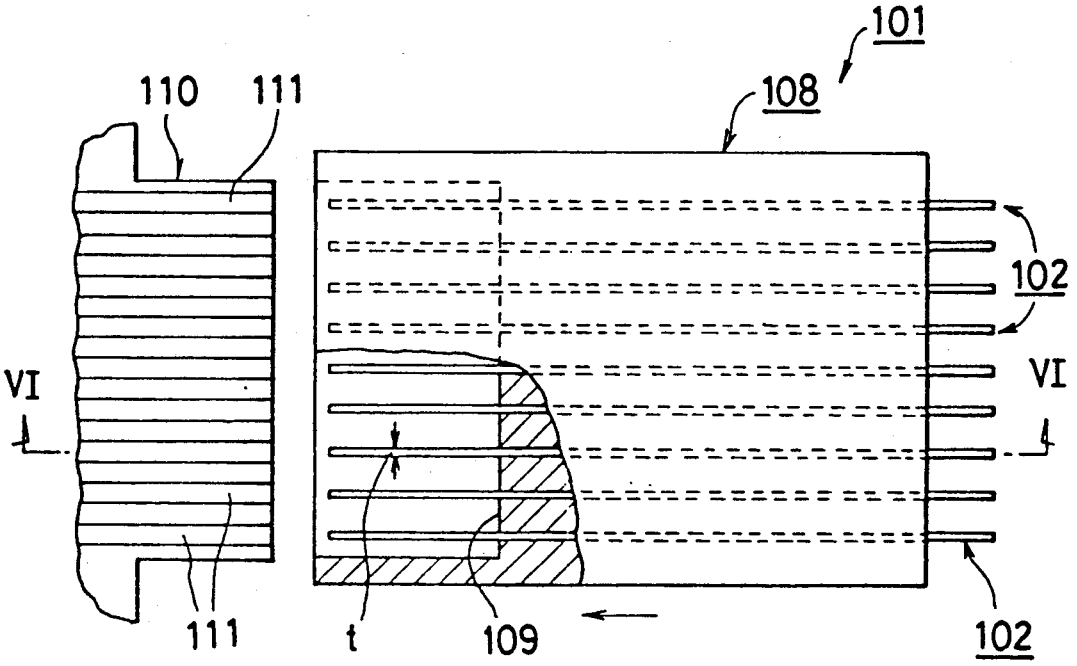
FIG. 5 PRIOR ART
FIG. 5 a partially cut-away plan view of a connector in which known contacts are employed.
Figure 6:
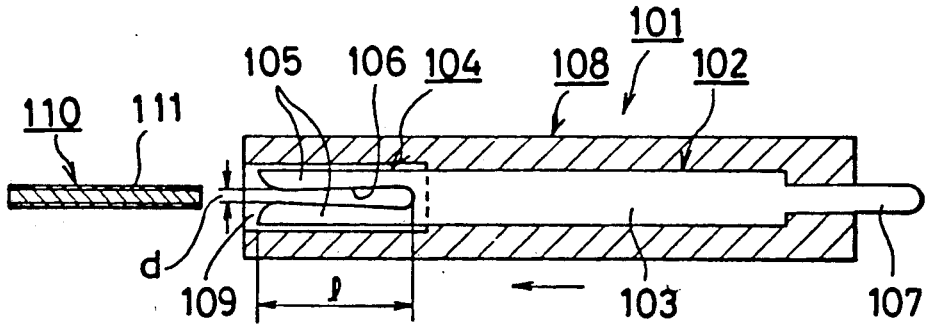
FIG. 6 PRIOR ART
FIG. 6 is a sectional view taken along the line VI—VI in FIG. 5.

As shown in FIGS. 1 and 2, an elongated body 1 having the width "$a_1$" of 0.9 mm is punched in a thin plate having the thickness of "$a_2$" of 0.9 mm and the same material such as that the contact 102, with a press. The conductive piece 1 has narrower end portions 2 and 2 at both ends respectively, the end portion having the length "$a_3$" of 3 mm and the largest width "$a_4$" of 0.35 mm. Each narrower end portion 2 is bent at the base and deviated by a half of the thickness "$a_2$" of the conductive piece 1.

A constriction 3 is formed at the middle of the conductive piece 1, and a conductive portion 4 is formed between the constriction 3 and the narrower end portion 2. The conductive portions 4 and 4 have a bore 5 and a projection 6 which tightly fits the bore 5, at remote ends.

As shown in FIG. 2, the conductive piece 1 is folded on itself at the middle of the constriction 3, so that the two conductive portions 4 and 4 are tightly overlapped by allowing the bore 5 to engage with the projection 6 to form a conductive part 7. The narrower end portions 2 and 2 opposite to each other forms a felmale contact portion 9 having a slit 8 having the smallest width "$a_2$" of 0.2 mm at one end, and the folded constriction 3 forms a contact portion 10 to constitute a contact 11 at the other end.

Thus, a male contact which is inserted in the slit is made not only in a flat shape, but also in rectangular or tubular shape since space is available in the direction of the thickness of the female contact portion 9.

According to the present invention, there is no need to form a slit when the conductive piece is punched in material, but a small contact is easily available in which the slit is longer than a known contact and the width "$a_2$" can be selectively determined.

Further the thickness of material can be freely selected regardless of its size, thereby manufacturing a connector smaller than a known connector and having high density and reliablity.

The foregoing merely relates to preferred embodiments of this invention, but various modifications and changes will be possible by person skilled in the art departing from the scope of claims as defined below.

What is claimed is:

1. A female contact for a connector, the contact comprising:

an elongated conductive piece, said elongated piece being formed of sheet metal and having a predetermined thickness and broader surfaces having a predetermined width which is substantially greater than said thickness, said piece having first and second edges;

said piece being folded at the center of the piece along one of the broader surfaces thereof; and said piece having narrower end portions at both ends of the piece, the narrower end portions being symmetrical to each other about the center of the piece, and one of said narrower portions having one side which is a substantial continuation of the first edge of said piece, and the other of said narrower portions having one side which is a substantial continuation of the second edge of said piece, the two narrower portions forming directly opposed, spaced apart jaws having facing surfaces and forming a forked receiver for receiving a contact terminal, with the facing surfaces of said jaws having a transverse extent substantially equal to said thickness of said conductive piece, and said jaws having a direction of movement toward and away from one another which is parallel to the broader surfaces of said conductive piece.

2. A contact as defined in claim 1 wherein a folded constriction is formed at the middle of the conductive piece, said folded constriction constituting a contact point at the opposite end of said contact from said jaws.

3. A method of assembling a female contact for a connector, the method comprising the steps of:

punching an elongated conductive piece having first and second narrower end portions at opposite ends with a press, the narrower end portions being symmetrical to each other around the center of the piece, said piece having a predetermined thickness, and a predetermined width which is substantially greater than said thickness, said piece having first and second edges;

said punching step including forming a generally rectangular elongated piece with said first and second narrower end portions at each end having edges which are a substantial continuation of said first and second edges, respectively; and folding the piece on itself at the center to form a forked receiver having spaced apart jaws having opposed surfaces suitable to receive a contact terminal and with the transverse extent of the opposed surfaces of said jaws being substantially equal to said predetermined thickness.

4. A method as defined in claim 3 wherein a constriction is formed at the middle of the conductive piece, to form a contact point for the female contact.

5. A method as defined in claim 3 wherein a bore is provided in the piece in the vicinity of one of the narrower end portions and a projection is provided on the piece in the vicinity of the other narrower end portion, the projection being engaged with the bore to fix the folded piece.

6. A method as defined in claim 3 including the step of bending said narrower end portions so that they are in substantially the same plane.

7. A contact as defined in claim 1 wherein a bore is provided in the piece in the vicinity of one of the narrower end portion and a projection is provided on the piece in the vicinity of the other narrower end portion, the projection being engaged with the bore to fix the folded piece.

8. A contact as defined in claim 7 wherein said bore has a central axis, and wherein the planes of the broader surfaces of said piece and the plane of the movement of said jaws are perpendicular to said axis.

9. A female contact for a connector, the contact comprising:

an elongated conductive piece, said elongated piece being formed of sheet metal and having a predetermined thickness and broader surfaces having a predetermined width which is substantially greater than said thickness, said piece having first and second edges;

said piece being folded at the center of the piece along one of the broader surfaces thereof; and said piece having narrower end portions at both ends of the piece, the narrower end portions being symmetrical to each other about the center of the piece, the two narrower portions forming spaced apart jaws having facing surfaces and forming a forked receiver for receiving a contact terminal, with the facing surfaces of said jaws having a transverse extent substantially equal to said thickness of said conductive piece, and said jaws being flexible toward and away from one another in a plane parallel to one of the broader surfaces of said piece.

* * * * *